US006960882B2

(12) United States Patent
Kobayashi

(10) Patent No.: US 6,960,882 B2
(45) Date of Patent: Nov. 1, 2005

(54) PLASMA DISPLAY DEVICE AND MANUFACTURING METHOD THEREOF

(75) Inventor: Arata Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 145 days.

(21) Appl. No.: 10/665,610

(22) Filed: Sep. 19, 2003

(65) Prior Publication Data

US 2004/0056598 A1 Mar. 25, 2004

(30) Foreign Application Priority Data

Sep. 25, 2002 (JP) ..... 2002-279125

(51) Int. Cl.[7] ..... H01J 17/49
(52) U.S. Cl. ..... 313/586; 313/582
(58) Field of Search ..... 313/582, 584, 313/586

*Primary Examiner*—Vip Patel
(74) *Attorney, Agent, or Firm*—Sonnenschein, Nath & Rosenthal LLP

(57) ABSTRACT

The present invention provides a plasma display device having an even and homogeneous dielectric layer and permitting a small luminance change over time. The plasma display device includes a first substrate, a second substrate disposed facing an inside of the first substrate so as to form a hermetically sealed discharge space therebetween, at least one pair of discharge sustain electrodes which are formed inside the first substrate 11 and forming a discharge gap therebetween, and the dielectric layer formed inside the first substrate so as to cover the discharge sustain electrodes. The dielectric layer has a low degassing film such that a total amount of degassing when increasing a temperature from room temperature to 1000° C. has hydrogen molecules not exceeding $1\times10^{20}$ particles/cm$^3$ and water not exceeding $5\times10^{20}$ particles/cm$^3$.

10 Claims, 6 Drawing Sheets

Change of luminance over time

Relationship Between Each Dielectric Film and Amount of Released $H_2$ Gas

Relationship Between Each Dielectric Film and Amount of Released $H_2$ Gas

PLASMA DISPLAY DEVICE AND MANUFACTURING METHOD THEREOF

CROSS REFERENCE TO RELATED APPLICATIONS

The present document is based on Japanese Priority Application JP2002-279125, filed in the Japanese Patent Office on Sep. 25, 2002, the contents of which being incorporated herein by reference to the extent permitted by law.

BACKGROUND OF THE INVENTION

1. Field of the Invention

The present invention relates to an AC (alternating current) drive type plasma display device having its feature in a dielectric layer, and a manufacturing method thereof.

2. Description of the Related Art

As a image display device which replaces a currently mainstream cathode ray tube (CRT), various types of flat type (flat panel type) display devices have been considered. Examples of such flat type display devices are a liquid crystal display (LCD), an electroluminescence display device (ELD), and a plasma display device (PDP: plasma display panel). Among them, the plasma display device has advantages in that it may be relatively easy to provide a large-sized screen and having a wide viewing angle; in addition, such display devices have satisfactory resistance to environmental factors, such as temperature, magnetic effects, vibration, etc. and has a prolonged lifetime, so that it is expected to be applied not only to flat television sets to be hanged on a wall for household use but also to large-scaled information terminal apparatuses for public use.

The plasma display device is a display device that obtains luminescence by applying voltage to a discharge cell containing discharge gas including rare gas within its discharge space so as to excite a phosphor layer in the discharge cell by means of an ultraviolet ray generated based on a glow discharge in the discharge gas. In other words, each discharge cell is driven by a principle similar to that of fluorescent light, discharge cells usually gather on the order of hundreds of thousands so as to constitute one display screen. Plasma display devices are roughly classified into a direct current drive type (DC type) and the alternating current drive type (AC type) according to the method of applying voltages to the discharge cells. Each type has advantages and disadvantages. The AC type plasma display device requires only forming a barrier rib in form of a stripe, for example, which plays the role of partitioning each of the discharge cells within the display screen, therefore it is suitable for high definition. As the surface of an electrode for discharge is coated with a protective layer made of a dielectric material, the electrode cannot be easily worn out, therefore it has the advantage of a prolonged lifetime.

As an example of the AC type plasma display device, a three-electrode type plasma display device shown in Japanese Patent Laid-Open No. H5-307935 and Japanese Patent Laid-Open No. H9-160525, for example.

The dielectric layer made from a dielectric material such as a low-melting point glass paste is provided at a display surface side panel in such an AC type plasma display device. Such a dielectric layer is usually formed by means of a screen printing process. In the drive of the AC type plasma display device, an electric charge is accumulated in the dielectric layer, and the accumulated charge is released by applying a reverse voltage to a discharge sustain electrode so as to generate plasma. In order to make an electric charge distribution as even as possible, the dielectric layer is needed to be even and homogeneous. In addition, preferably the dielectric layer is a finely structured layer from a viewpoint of improving dielectric withstanding voltage and from a viewpoint of damage prevention of the discharge sustain electrode located thereunder. Moreover, from a viewpoint of an improvement in luminance, a thickness of the dielectric layer should be preferably as thin as possible.

SUMMARY OF THE INVENTION

When forming the dielectric layer made from the low melting point glass paste by means of the screen printing process, many difficulties may be originated for forming an even and homogeneous dielectric layer. Moreover, many further difficulties may be caused when trying to form an accurate dielectric layer as well as a thin dielectric layer.

In addition, a method for forming a dielectric layer made of $SiO_2$ by means of a chemical vapor deposition process (Chemical Vapor Deposition process, CVD process) has been also taken into consideration. Although the dielectric layer having $SiO_2$ and obtained by the CVD process may prevent the above-mentioned difficulties, it still has a problem in that a luminance fall over time is significant as compared with conventional methods.

In view of the above, the present invention has been conceived so as to provide a plasma display device having an even and homogeneous dielectric layer and allowing a small luminance change over time.

The inventors of the present invention have achieved completion of a plasma display device allowing small luminance change over time, and have discovered that when a total amount of degassing from a dielectric layer is equal to or less than a predetermined value, the luminance change over time becomes relatively small.

In other words, the plasma display device according to a preferred embodiment of the present invention includes a first substrate; a second substrate disposed facing an inside of the first substrate and forming a hermetically sealed discharge space therebetween; at least a pair of discharge sustain electrodes formed inside the first substrate and mutually forming a discharge gap; and a dielectric layer formed inside the first substrate so as to cover the discharge sustain electrodes; the dielectric layer has a low degassing film in which a total amount of degassing when increasing a temperature from room temperature to 1000° C. comprises hydrogen molecules not exceeding $1\times10^{20}$ particles/cm$^3$ and water molecules not exceeding $5\times10^{20}$ particles/cm$^3$.

Preferably, the plasma display device according to the preferred embodiment of the present invention has a thickness of the dielectric layer not exceeding $5.0\times10^{-5}$ m.

According to the plasma display device according to the preferred embodiment of the present invention, the dielectric layer has a high density and is even and homogeneous as compared with a conventional plasma display device, therefore an abnormal discharge and abnormal distribution of an electric charge are unlikely to take place, thus improving discharge stability. For this reason, reliability of the plasma display device increases and its luminance may be improved. Moreover, a more finely structured dielectric layer may be provided so that its dielectric withstanding voltage may be improved and a discharge sustain electrode located thereunder may be prevented from being damaged. Therefore, the luminance change over time is suppressed, so that a lifetime of the plasma display device may be prolonged. In addition, since it is possible to form a sufficiently thin dielectric layer, a distance between a pair of discharge sustain electrodes may be reduced, to thereby improve the luminance from this aspect, too.

Moreover, in the plasma display device according to the preferred embodiment of the present invention, it is possible to prevent an ion and an electron from being brought into direct contact with the discharge sustain electrode by preparing an even and homogeneous dielectric layer and, as a result, the discharge sustain electrode may be prevented from being worn out. In addition, the dielectric layer has not only the function that accumulates a wall charge but also a resistor function to limit an excessive discharge current and a memory function to sustain a discharge state.

Preferably, inside the above-mentioned second substrate, a plurality of address electrodes are formed along a direction which crosses the above-mentioned discharge sustain electrodes, and a second substrate side dielectric film is formed so as to cover the address electrodes.

In this case, preferably the above-mentioned second substrate side dielectric film has a low degassing film in which the total amount of the degassing from the second substrate side dielectric film does not exceed $1\times10^{20}$ particles/cm$^3$ for hydrogen molecules and, for water, it does not exceed $5\times10^{20}$ particles/cm$^3$ when heated from room temperature to 1000° C.

Preferably, in the present invention, the dielectric layer and the second substrate side dielectric film each has a low degassing film, but they may partially have the low degassing film.

Also preferably, the total amount of the degassing when increasing the temperature of the low degassing film from room temperature to 500° C. is equal to or less than $5\times10^{19}$ particles/cm$^3$ for hydrogen molecules, and that for water it is equal to or less than $5\times10^{19}$ particles/cm$^3$. In this case, the luminance change over time may be further suppressed. The total amount of the degassing from a low degassing film is preferably as small as possible for both hydrogen molecules and water, however it is practically difficult to obtain degassing down to complete zero.

Preferably, the low degassing film may be any among an oxide, a nitride, and an oxynitride. The oxide, the nitride and the oxynitride may be respectively exemplified by $SiO_x$, $SiN_x$, and $SiO_xN_y$.

In the present invention, it is preferable that a protective film is formed on an inner surface on the discharge space side in the dielectric layer. As a material for constituting the protective film, examples include magnesium oxide (MgO), magnesium fluoride ($MgF_2$), and calcium fluoride ($CaF_2$). Amongst these materials, magnesium oxide (MgO) is preferable because it provides special features such as a high secondary electron release ratio, a low sputter rate, high optical transmittance in a luminescence wavelength of a phosphor layer, and a low discharge start voltage. In addition, the protective film may be a laminated structure having at least two kinds of materials selected from those materials.

In order to manufacture the plasma display device according to the present invention, it is preferable to form the low degassing film by means of the CVD process, a sputtering process, an evaporation process (including a vacuum evaporation process), an ion plating process, a printing process, a dry film process, an application process (including a spray coating process), or a transfer process. Amongst these processes or methods, by employing the sputtering process or the CVD process, etc., the dielectric layer may be formed made of a thin, finely structured and made of a low degassing film which is also even and homogeneous.

The method of forming the dielectric film and the low degassing film constituting the second substrate side dielectric film may be more specifically exemplified by:

(a) various vacuum evaporation processes such as an electron beam heating process, a resistance heating process, a flash deposition process;

(b) plasma vacuum evaporation process;

(c) a bipolar sputtering process, a direct current sputtering process, a direct current magnetron sputtering process, a high frequency sputtering process, a magnetron sputtering process, an ion beam sputtering process and a bias sputtering process; and (d) various ion plating processes such as a DC (direct current) process, an RF (radio frequency) process, a multi-negative pole process, an activation reacting process, an electrolysis vacuum evaporation process, a high frequency ion plating process, and a reactive ion plating process, a pulse laser deposition process, etc.

As for each sputtering process included in item (c) above, by setting a partial pressure of $O_2$ when forming a film to be 15 volume percent or more, possible defects in the film may be reduced so as to avoid degassing from the film. In addition, the oxygen partial pressure is not specifically limited if it is not less than 15 volume percent, however, the maximum thereof is limited to 50 volume percent. If the oxygen partial pressure is excessively high, a film forming rate may drop considerably, so that the 50 percent tends to be a practical limit.

Moreover, the CVD process may be exemplified by an atmospheric pressure CVD process (APCVD process), a low pressure CVD process (LPCVD), a low temperature CVD process, a high temperature CVD process, plasma CVD processes (a PCVD process, a PECVD process), an ECR plasma CVD process, and a photo CVD process. Here, a substrate temperature when forming the film is preferably not less than 330° C. The degassing from the film may be suppressed by increasing the temperature. In addition the maximum of substrate temperature is preferably equal to or less than 450° C., but not limited thereto. When the substrate temperature is excessively high, the wiring metal tends to be damaged.

Preferably, the plasma display device according to the preferred embodiment of the present invention is of an AC drive type and has a three-electrode structure.

Therefore, as described above, the present invention may provide a plasma display device having an even and homogeneous dielectric layer and also allowing a small luminance change over time.

BRIEF DESCRIPTION OF THE DRAWINGS

The above and other features and advantages of the present invention will become more apparent from the following description of the presently exemplary preferred embodiment of the present invention taken in conjunction with the accompanying drawings, in which.

DESCRIPTION OF THE PREFERRED EMBODIMENTS OF THE PRESENT INVENTION

Figure 1:
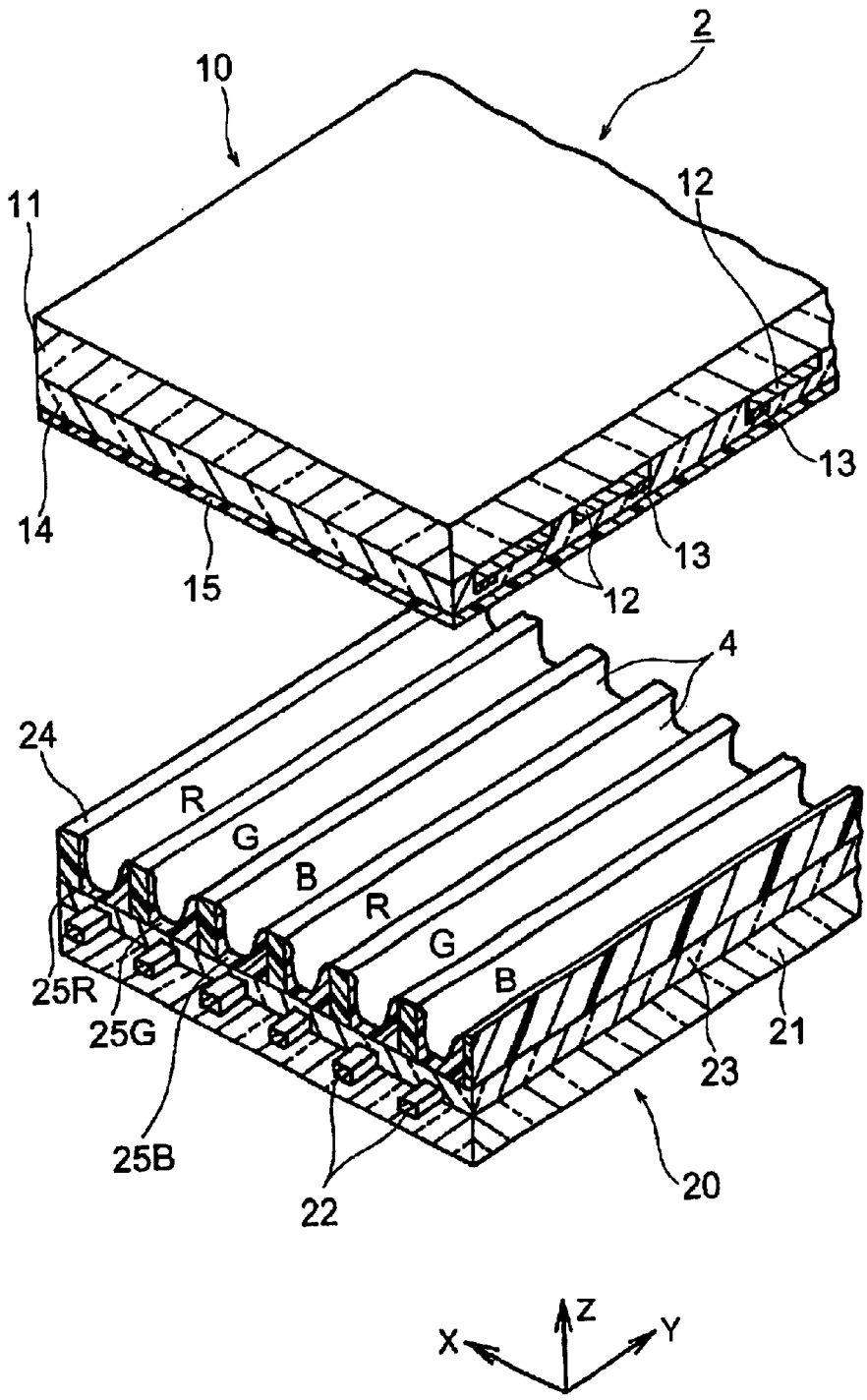
FIG. 1 is a schematic partially exploded perspective view of a plasma display device according to a preferred embodiment of the present invention.

Overall Structure of the Plasma Display Device:

With reference to FIG. 1, an overall structure of the alternating current drive type (AC type) plasma display device (which may be hereafter referred to as plasma display device) will be described.

The AC type plasma display device 2 as shown in FIG. 1 is arranged such that a first panel 10 corresponding to a front panel and a second panel 20 corresponding to a rear panel are laminated to each other. Luminescence of the phosphor layers 25R, 25G, and 25B on the second panel 20 is observed through the first panel 10. In other words, the first panel 10 is on a display surface side.

The first panel 10 includes a first transparent substrate 11, a plurality pairs of discharge sustain electrodes 12 provided substantially parallel to one another in stripes along a first direction X on the first substrate 11 and made from a transparent and electrically conductive material, a bus electrode 13 provided to reduce impedance of discharge sustain electrode 12 and made from a material of lower electric resitivity than that of the discharge sustain electrode 12, a dielectric layer 14 formed on the first substrate 11 including the bus electrode 13 and the discharge sustain electrodes 12, and a protective layer 15 formed on the dielectric layer 14. In addition, the protective layer 15 need not be necessarily be formed, however it is preferable to have such protective layer 15.

On the other hand, the second panel 20 comprises the second substrate 21, a plurality of address electrodes 22 (which may be referred to as data electrodes) formed substantially parallel to one another on the second substrate 21 in stripes and along a second direction Y (substantially perpendicular to the first direction X), an insulator film 23 formed on the second substrate 21 including on the address electrodes 22, an insulating barrier rib 24 formed on the insulator film 23, and a phosphor layer continuously provided on from the insulator film to a side wall surface of the barrier rib 24. The phosphor layer includes a red phosphor layer 25R, a green phosphor layer 25G, and a blue phosphor layer 25B.

FIG. 1 is a schematic partially exploded perspective view of the display device, in particular, a top portion of the barrier rib 24 on the second panel 20 side is in contact with the protective layer 15 on the first panel 10 side in a third direction Z (which is a direction orthogonal to the first direction X and the second direction Y). The discharge gas is introduced in the discharge spaces 4 surrounded by the barrier ribs 24 in which the phosphor layers 25R, 25G and 25B are formed and the protective layer 15. The first panel 10 and the second panel 20 are joined by means of frit glass in the circumferential portions thereof.

As for discharge gas introduced in the discharge space 4, He (resonance line wavelength=58.4 nm), Ne (resonance line wavelength=74.4 nm), Ar (resonance line wavelength=107 nm), Kr (resonance line wavelength=124 nm), and Xe (resonance line wavelength=147 nm) may be employed independently or in a mixture, but not limited to, especially the mixed gas that can be expected to decrease the discharge start voltage by the Penning effect is useful. The mixed gas may be a Ne—Ar mixture gas, a He—Xe mixture gas, a Ne—Xe mixture gas, a He—Kr mixture gas, a Ne—Kr mixture gas, or a Xe—Kr mixture gas. Especially Xe, that has the longest resonance line wavelength among the rare gases also emits a strong vacuum ultraviolet ray at a molecule beam wavelength of 172 nm and therefore it can be considered an appropriate rare gas. In addition the following items (1) to (4) are characteristics required for a discharge gas.

(1) From a view point of the acquisition of a prolonged lifetime of the alternating current drive type plasma display device, it should be chemically stable and set to a high gas pressure.

(2) From a view point of high luminance of the display screen, radiation intensity of the vacuum ultraviolet ray should be high.

(3) From a view point of raising energy conversion efficiency from the vacuum ultraviolet ray to visible light, the wavelength of the emitted vacuum ultraviolet ray should be long.

(4) From a view point of reducing power consumption, the discharge start voltage should be low.

Figure 2:
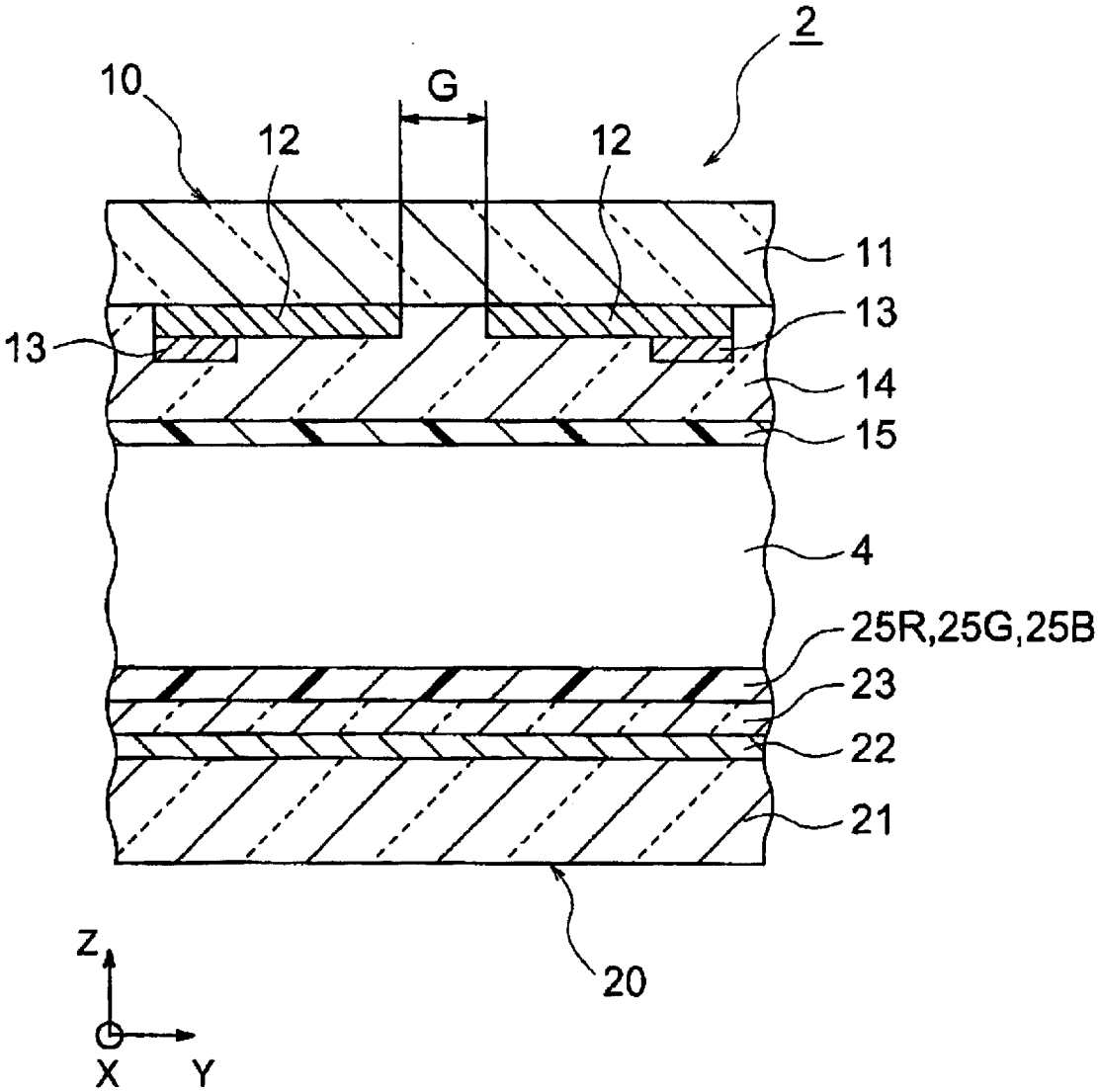
FIG. 2 is a schematic partial cross-sectional view of the plasma display device shown in FIG. 1.

Preferably the total pressure of the introduced discharge gas is not particularly limited, however, it is preferably from $1\times10^2$ Pa to $5\times10^5$ Pa and more preferably from $1\times10^3$ Pa to $4\times10^5$ Pa. In addition, when setting a distance (discharge gap G as shown in FIG. 2) between a pair of discharge sustain electrodes 12 to less than $5\times10^{-5}$ m, the pressure of the rare gas in the discharge space should not be less than $1\times10^2$ Pa and not exceeding $3\times10^5$ Pa, preferably not less than $1\times10^3$ Pa and not exceeding $2\times10^5$ Pa, and still more preferably not less than $1\times10^4$ Pa and not exceeding $1\times10^5$ Pa. By selecting the pressure ranges in such way, the phosphor layers are irradiated with the vacuum ultraviolet rays generated in the rare gas emit light in a satisfactory manner. Under those pressure ranges, higher pressure results in a lower sputter rate of each member constituting the alternating current drive type display device, whereby the lifetime of the alternating current drive type plasma display device can be prolonged.

The plasma display device 2 according to the preferred embodiment of the present invention is a so-called reflection type plasma display device, and luminescence of the phosphor layers 25R, 25G, and 25B is observed through the first panel 10. For this reason, regardless of whether a conductive material constituting the address electrode 22 is transparent or opaque, a conductive material constituting the discharge sustain electrode 12 needs to be transparent. In addition, a state being transparent or opaque as described here is based on optical permeability of the conductive material at the luminescence wavelength (visible light range) inherent to a phosphor layer material. In other words, if it is transparent to a light emitted from the phosphor layer, it may be considered that the conductive material constituting the discharge sustain electrode or the address electrode is transparent.

An opaque conductive material may utilize Ni, Al, Au, Ag, Pd/Ag, Cr, Ta, Cu, Ba, $LaB_6$, and $Ca_{0.2}La_{0.8}CrO_3$ independently or in an appropriate combination. A transparent conductive material may be ITO (indium tin oxide) or $SnO_2$, for example. The discharge sustain electrode 12 or the address electrode 22 may be formed by means of the sputtering process, the vacuum evaporation process, the screen printing process, the plating process, etc., and patterning is carried out by means of a photolithography process, a sandblast process, a lift-off process, etc.

The dielectric layer 14 formed on a surface of the discharge sustain electrode 12 includes only a low degassing film. As to the low degassing film, the total amount of the degassing when increasing the temperature from room temperature to 1000° C. does not exceed $1\times10^{20}$ particles/$cm^3$ of hydrogen molecules and not exceeding $5\times10^{20}$ particles/$cm^3$ of water molecules. Preferably, as to the low degassing film, the total amount of the degassing when increasing the temperature from the room temperature to 500° C. does not exceed $5\times10^{19}$ particles/$cm^3$ of hydrogen molecules and not exceeding $5\times10^{19}$ particles/$cm^3$ of water.

A low degassing film may include an oxide, a nitride, or an oxynitride. The oxide may be $SiO_x$, a nitrogenous substance may be $SiN_x$, and the oxynitride may be $SiO_xN_y$. It is preferable to form the low degassing film by means of the CVD process, the sputtering process, the evaporation process (including the vacuum evaporation process), the ion plating process, the printing process, the dry film process, the application process (including the spray coating process), or the transfer process. Among these, by employing the sputtering process, the CVD process, etc., a dielectric layer may be formed thin, finely structured, and a low degassing film which is also even and homogeneous can be formed.

Although not limited to the following values, it is preferable that the thickness of the dielectric layer 14 does not exceed $5.0\times10^{-5}$ m and more preferably, does not exceed 1 to 10 $\mu$m.

It is possible to prevent an ion and an electron generated in the discharge space 4 from being brought into direct contact with the discharge sustain electrode 12 by preparing the dielectric layer 14. Consequently, the discharge sustain electrode 12 may be prevented from being worn out. The dielectric layer 14 has the memory function of accumulating a wall charge generated during an address period and maintaining a discharge state, and a resistance function of constraining excessive discharge current.

The protective layer 15 formed on the discharge space side surface of the dielectric layer 14 protects the dielectric layer 14, and allows preventing the ion and the electron from being brought into direct contact with the discharge sustain electrode. Consequently, the discharge sustain electrode 12 and the dielectric layer 14 may be effectively prevented from being worn out. Moreover, the protective layer 15 also has a secondary electron emission function, which is required for discharge. The material for constituting the protective layer 15 may be magnesium oxide (MgO), magnesium fluoride ($MgF_2$), or calcium fluoride ($CaF_2$). Among these materials, the magnesium oxide is a preferable one, as it has advantages in that it is chemically stable, its sputter rate is low, the optical transmittance at the luminescence wavelength of the phosphor layer is high, and the discharge start voltage is low. In addition, the protective layer 15 may be a lamination structure formed of at least two kinds of materials selected from the group consisting of those materials.

As constituents of the first substrate 11 and the second substrate 21, high distortion point glass, soda glass ($Na_2O.CaO.SiO_2$), borosilicate glass ($Na_2O.B_2O_3.SiO_2$), a forsterite ($2MgO.SiO_2$), and lead glass ($Na_2O.PbO.SiO_2$) may be illustrated as examples. Although the constituents of the first substrate 11 and the second substrate 21 may differ from each other or be the same, preferably their heat expansion coefficients are the same.

The phosphor layers 25R, 25G, and 25B each include a phosphor layer material selected from the group consisting of a phosphor layer material which emits a red light, a phosphor layer material which emits a blue light, and a phosphor layer material which emits a a green light are provided above the address electrodes 22. When the plasma display device is a color display, specifically, the phosphor layer (red phosphor layer 25R) including the phosphor layer material which emits the red light is provided above an address electrode 22, for example. The phosphor layer (green phosphor layer 25G) including the phosphor layer material which emits the green light is provided above another address electrode 22. The phosphor layer (blue phosphor layer 25B) including the phosphor layer material which emits the blue light is provided above still another address electrode 22. These phosphor layers which emit light of three primary colors are in one set and arranged in a predetermined order.

An area where a pair of discharge sustain electrodes and a set of phosphor layers which emits light of the three primary colors overlap corresponds to one pixel. The red phosphor layer, the green phosphor layer, and the blue phosphor layer may be formed in stripes may be formed in a grid pattern.

The phosphor layer materials constituting the phosphor layers 25R, 25G, and 25B may be suitably selected from conventional phosphor layer materials so as to employ those of a high quantum efficiency and low saturation with respect to the vacuum ultraviolet ray. When a color display is considered, it is preferable to combine the phosphor layer materials such that color purity is close to three primary colors defined by the NTSC system, white balance is achieved when mixing the three primary colors, each afterglow time is short, and each afterglow time of the three primary colors is substantially the same.

Particular examples of the phosphor layer materials are shown as follows:

For example, the phosphor layer materials emitting red light by irradiation of the vacuum ultraviolet ray may include ($Y_2O_3$:Eu), ($YBO_3$Eu), ($YVO_4$:Eu), ($Y_{0.96}P_{0.60}V_{0.40}O_4$:$Eu_{0.04}$), [(Y, Gd)$BO_3$:Eu], ($GdBO_3$:Eu), ($ScBO_3$:Eu), ($3.5MgO.0.5MgF_2.GeO_2$:Mn). The phosphor layer materials emitting green light by irradiation of the vacuum ultraviolet ray may be ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb), ($Sr_4Si_3O_8C_{14}$:Eu), for example. The phosphor layer materials emitting blue light by irradiation of the vacuum ultraviolet ray can be ($Y_2SiO_5$:Ce), ($CaWO_4$:Pb), $CaWO_4$, $YP_{0.85}V_{0.15}O4$, ($BaMgAl_{14}O_{23}$:Eu), ($Sr_2P_2O_7$:Eu), ($Sr_2P_2O_7$:Sn), etc.

Processes of forming the phosphor layers 25R, 25G, and 25B may include a thick film printing process, a process of spraying phosphor layer particles, a process in which an adhesive substance is applied in advance to a position where the phosphor layer to be formed and a phosphor layer particle is adhered thereto, a process in which a photosensitive phosphor layer paste is used to carry out patterning of the phosphor layer by exposure and development, and a process in which after forming a phosphor layer over the whole surface an unnecessary portion is removed by means of the sandblast process.

In addition, the phosphor layers 25R, 25G, and 25B may be directly formed on the address electrodes 22, or may be continuously formed from tops of the address electrodes 22 to the side wall surfaces of the barrier ribs 24. Alternatively, the phosphor layers 25R, 25G and 25B may be formed on the insulator film 23 provided on the address electrodes 22, or may be continuously formed from a top of the insulator film 23 provided on the address electrodes 22 to the side wall surfaces of the barrier ribs 24. In addition, the phosphor layers 25R, 25G, and 25B may be formed only on the side wall surfaces of the barrier ribs 24. As a constituent of the insulator film, the low melting point glass and $SiO_2$ may be illustrated. However, in the preferred embodiment, it is preferable to constitute the insulator film from the same material as that of the dielectric layer 14. In some cases, a second protective film made of magnesium oxide (MgO), magnesium fluoride ($MgF_2$), calcium fluoride ($CaF_2$), etc. may be formed on a surface of the phosphor layer or the barrier rib.

A constituent of the barrier rib 24 may employ conventional insulating materials such as a mixture in which low melting point glass widely used in the conventional art is mixed with metal oxides, such as alumina. The height of the barrier rib 24 is of the magnitude of 50 to 200 $\mu$m.

The discharge gas containing the mixed gas is introduced in the discharge space 4 surrounded by the barrier rib 24, and the phosphor layers 25R, 25G, and 25B are irradiated with the ultraviolet ray generated based on the glow discharge generated in the discharge gas in the discharge space 4 so as to emit light.

In the preferred embodiment one discharge cell is constituted by a pair of barrier ribs 24 formed on the second substrate 21, a pair of discharge sustain electrodes 12 and 12 and the address electrodes 22 which occupy the inside of the area surrounded by a pair of barrier ribs 24, and the phosphor layers 25R, 25G, and 25B. The discharge gas containing the mixed gas is introduced in this discharge cell, more particularly in the discharge space surrounded by the barrier rib 24, the phosphor layers 25R, 25G, and 25B are irradiated with the ultraviolet ray generated based on an alternating current glow discharge generated in the discharge gas in the discharge space, so as to emit light.

In the preferred embodiment of the present invention, the direction in which a projection image of the discharge sustain electrode 12 (the bus electrode 13) is extended, and the direction in which a projection image of the address electrode 22 is extended are substantially orthogonal to each other (it is not necessary to be orthogonal to each other). As shown in FIG. 2, in the preferred embodiment, the discharge gap G formed between each pair of discharge sustain electrodes 12 formed along the first direction X is preferably 5 to 150 $\mu$m, more preferably less than $5\times10^{-5}$ m, but not limited to these values.

In order to form the discharge gap G for each discharge cell, the discharge sustain electrode 12 made of the transparent electrode is continuously formed along the first direction X, but may be completely separated for each discharge cell in the first direction X so as to be formed in an island-shape. By separating and forming the discharge sustain electrode 12 made of the transparent electrode in the first direction X for each discharge cell, an invalid current may be reduced without reducing its luminance, so as to contribute to reduction of consumption current. However, the bus electrode 13 which constitutes a portion of discharge sustain electrode 12 may not be divided along the first direction X since a voltage signal is supplied to the discharge sustain electrode 12 made of the transparent electrode. Each of the discharge sustain electrodes 12 includes the transparent electrode, and is of relatively high resistance, so that each of the discharge sustain electrodes 12 is connected to the bus electrode 13 formed along the first direction X.

In addition, since glow discharge takes place between a pair of discharge sustain electrodes 12 which form the discharge gap G, this type of plasma display device is referred to as a "surface discharge type." A method of driving the plasma display device will be described hereafter.

In the present preferred embodiment of the present invention as described above, a width of the discharge sustain electrodes 12 in the second direction Y is preferably 80 to 280 $\mu$m.

The bus electrode 13 is connected to each of the discharge sustain electrodes 12 along the longitudinal direction. Typically, the bus electrodes 13 may made of a single layer metal film of metal material such as Ag, Au, Al, Ni, Cu, Mo, Cr, etc., or a laminated film such as Cr/Cu/Cr, etc. The bus electrode 13 may be formed in a similar manner to that for the discharge sustain electrodes 12 and 12, for example.

In a reflection type plasma display device, the bus electrode made from the metal material may be a reason that transmission quantity of the visible light which is emitted from the phosphor layer and passes the first substrate 11 is reduced and the luminance of the display screen is reduced, so that preferably, it is formed as thinly as possible, as far as the electric resistance required for the whole discharge sustain electrode is obtained.

However, the sustain electrode material according to the preferred embodiment of the present invention is not limited to a transparent material. When an opaque material is used, an aperture ratio is reduced, however, the opaque material does not always constitute a problem if high luminance is provided, even if the aperture ratio is reduced.

Method of Manufacturing the Plasma Display Device

Next, a method of manufacturing the plasma display device according to a preferred embodiment of the present invention will be described. The first panel 10 as shown in FIG. 1 or 2 may be prepared by the following methods. At first, a plurality of discharge sustain electrodes 12 are formed in such a manner that an ITO layer is formed by means of the sputtering process, for example, over the whole first substrate 11 made from the high distortion point glass or the soda glass and patterning of the ITO layer is carried out by means of a photolithography technology and an etching technology in a stripe shape.

Next, a chromium film is formed over the whole inside surface of the first substrate 11 by means of the vacuum evaporation process, for example, and patterning of the chromium film is carried out by means of the photolithography technology and the etching technology so as to form the bus electrodes 13 inside each of the discharge sustain electrodes 12. Then, the dielectric layer 14 is formed over the whole inside surface of an interconnect electrode of the first substrate 11 in which the bus electrode 13 is formed.

In the preferred embodiment of the present invention, the process of forming the dielectric layer 14 may preferably include the following processes in order to form the low degassing film, however the present invention is not limited to these processes:

(a) various vacuum evaporation processes such as the electron beam heating process, a resistance heating process, a flash deposition process;

(b) a plasma vacuum evaporation process;

(c) a two-pole sputtering process, a direct-current sputtering process, a direct-current magnetron sputtering process, a high frequency sputtering process, a magnetron sputtering process, an ion beam sputtering process and the bias sputtering process; and (d) various ion plating processes such as a DC (direct current) process, a RF process, a multi-negative pole process, a activation reacting process, a electrolysis vacuum evaporation process, a high frequency ion plating process, and a reactive ion plating process, a laser abrasion process, etc.

Next, the protective layer 15 made of magnesium oxide (MgO) with a thickness of 0.6 $\mu$m is formed on the dielectric layer 14 by means of the electronic beam vacuum evaporation process or the sputtering process. Therefore, the first panel 10 may be completed according to the above processes.

Moreover, the second panel 20 is prepared by the following processes. At first, an aluminum film is formed on the second substrate 21 made from the high distortion point glass or the soda glass by means of the vacuum evaporation process, for example, and the address electrode 22 is formed by carrying out patterning with the photolithography technology and the etching technology. The address electrode 22 is extended in the second direction Y which is orthogonal to the first direction X. Next, a low melting point glass paste layer is formed over the whole inside of the interconnect electrode by the screen printing process, and the insulator film 23 is formed by baking the low melting point glass paste layer.

Then, the barrier rib 24 is formed on the insulator film 23 so as to be in the stripe pattern as shown in FIG. 1 and FIG. 2. The formation process is not specifically limited, and therefore may employ, for example, the screen printing process, the sandblast process, the dry film process, an exposing process, etc.

The screen printing process is a process in which openings are formed in a portion of the screen corresponding to a portion where a barrier rib is to be formed, and a barrier rib forming material on the screen is passed through the openings by means of a squeegee so as to form a barrier rib forming material layer on the substrate or the dielectric film (hereafter, these are generically referred to as "on the substrate"), then the barrier rib forming material layer is baked.

The dry film process is a process of laminating a photosensitive film onto a substrate, removing the photosensitive film located at a portion where the barrier rib is to be formed by means of the exposure and development, embedding the barrier rib forming material in the openings prepared by removal, and baking. Consequently, the photosensitive film is burned and removed by the baking, so that the barrier rib forming material embedded in the openings is left remaining as the barrier rib 24.

The exposure process is a process in which the barrier rib forming material layer which has photosensitivity is formed on the substrate, patterning of the material layer is carried out by means of the exposure and development then the baking is performed.

A sandblast forming process includes, for example, a process in which the barrier rib forming material layer is formed on the substrate by means of the screen printing, a roll coater, a doctor blade, a nozzle discharge type coater etc., so as to be dried. After drying, a portion, where the barrier rib is formed, of the barrier rib forming material layer is covered with a mask layer, then the exposed portion of the barrier rib forming material layer is removed by means of the sandblast process.

The baking (barrier rib baking process) for forming the barrier rib is carried out in the air, and a baking temperature is approximately 560° C. The baking time is approximately 2 hours.

Next, phosphor layer slurry of the three primary colors is printed one by one between the barrier ribs 24 formed in the second substrate 21. Then, the second substrate 21 is baked in a kiln, so that the phosphor layers 25R, 25G, and 25B are formed from over the insulator film between barrier ribs 24 to the side wall surface of the barrier ribs 24. The baking (phosphor substance baking process) temperature at that time is approximately 510° C. The baking time is approximately 10 minutes.

Next, the plasma display device is assembled. In other words, a seal layer is first formed at peripheral edges of the second panel 20 by means of screen printing. Then, the first panel 10 and the second panel 20 are laminated to each other, and baked so as to cure the seal layer. Then, after exhausting air from the space formed between the first panel 10 and the second panel 20, a discharge gas is introduced, and the space is hermetically sealed, to thereby complete the plasma display device 2.

An example of operation of the plasma display device having such a construction will be described as follows. At first, for example, a panel voltage higher than the discharge start voltage Vbd is applied, for a short period of time, to one common side of every pair of discharge sustain electrodes 12. Thus, glow discharge takes place, a wall charge is accumulated on the surface of the dielectric layer 14 in the vicinity of both discharge sustain electrodes 12 and 12, and the discharge start voltage is reduced. Then, by applying voltage to the address electrode 22, voltage is applied to the other scan side discharge sustain electrode 12 of the pair of discharge sustain electrodes included in a discharge cell which is not to be displayed, so that glow discharge is generated between the address electrode 22 and the other scan side discharge sustain electrode 12, so as to erase the accumulated wall charge. The discharge erase is performed one by one for each address electrodes 22. On the other hand, no voltage is applied to one scan side discharge sustain electrodes 12 of a pair thereof included in the discharge cell which is to be displayed, whereby the accumulation of the wall charge is sustained. Then, by applying a predetermined pulse voltage across every pair of discharge sustain electrodes 12 and 12, glow discharge begins between a pair of discharge sustain electrodes 12 and 12 in a cell by which the wall charge has been accumulated. In the discharge cell, the phosphor layer excited by irradiation of the vacuum ultraviolet ray generated based on the glow discharge in the discharge gas in the discharge space provides characteristic luminescence color according to the kind of phosphor layer material. In addition the phases of the discharge sustain voltage applied to one common side discharge sustain electrode 12 and the other scan side discharge sustain electrodes 12 of a pair of electrodes are displaced from each other by a half cycle period, and the polarities of the electrodes are reversed according to a frequency of the alternating current.

Alternatively, an alternating current glow discharge operation of the plasma display device 2 according to the preferred embodiment may also be carried out as follows. First, in order to initialize all pixels, erase discharge is carried out for all pixels. Subsequently, a discharge operation is performed. The discharge operation is divided into two sub-operations. One is carried out during an address period when a wall charge is generated by an initial discharge. The other is carried out during a discharge sustain period when the glow discharge is sustained. During the address period, a pulse voltage lower than the discharge start voltage Vbd is applied, for a short period of time, to one discharge sustain electrodes which has been selected and a selected address electrode. An area where the one discharge sustain electrode to which the pulse voltage is applied and the address electrode overlap with each other is chosen as a display pixel. In the overlapped area, because of dielectric polarization, a wall charge takes place on a surface of a dielectric layer so that the wall charge is accumulated. In the subsequent discharge sustain period, a discharge sustain voltage Vsus lower than Vbd is applied to a pair of discharge sustain electrode. If the sum of the wall voltage Vw and the discharge sustain voltage Vsus caused by the wall charge becomes larger than the discharge sustain voltage Vbd (or Vw+Vsus>Vbd), a glow discharge is started. The phase of the discharge sustain voltage Vsus applied to the one discharge sustain electrode and the other discharge sustain electrode are displaced from each other by a half cycle period, and the polarities of discharge sustain electrodes are reversed according to the frequency of the alternating current.

In the plasma display device 2 according to the preferred embodiment of the present invention, the dielectric layer 14 has high density and is even and homogeneous as compared with the conventional plasma display devices, and therefore does not have tendency of having an abnormal discharge or an abnormal distribution of the electric charge, so as that discharge stability may be improved. For this reason, reliability of the plasma display device 2 becomes higher and its luminance may be improved. Moreover, a more finely structured dielectric layer 14 can be provided so that its withstanding voltage may be improved and its discharge sustain electrode 12 located thereunder may be prevented from being damaged. Therefore, the luminance change over time is suppressed, so that a lifetime of the plasma display device 2 may be prolonged. In addition, since it is possible to form a sufficiently thin dielectric layer 14, a distance between a pair of discharge sustain electrodes 12 may be reduced, to thereby improve the luminance in this regard, too.

Moreover, in the plasma display device 2 according to the preferred embodiment of the present invention, it is possible to prevent an ion and an electron from being brought into direct contact with the discharge sustain electrode 12 by preparing the even and homogeneous dielectric layer 14, as a result, the discharge sustain electrode 12 may be prevented from being worn out. In addition the dielectric layer 14 has not only the function that accumulates the wall charge but also a resistor function to limit an excessive discharge current and a memory function to maintain a discharge state.

Other Preferred Embodiments

The present invention is not limited to the above-described preferred embodiments and may be modified within the scope of the present invention.

For example, the above-described preferred embodiments may provide a three-electrode type plasma display device wherein a pair of discharge sustain electrodes 12 and 12 formed inside the first substrate 11 and the address electrode 22 is formed at the second substrate 21. In this case, projection images of the pair of discharge sustain electrodes 12 and 12 are in parallel with each other and extended in the first direction X, and a projection image of the address electrode 22 is extended in the second direction Y, so that the pair of discharge sustain electrodes 12 and the address electrode 22 may be arranged to cross, however the present invention is not limited thereto. For example, it is possible to apply the present invention to a two-electrode type alternating current drive type plasma display device. If it is the case "address electrode" in the above description is replaced with "the other discharge sustain electrode", as needed.

In addition, in the above-described preferred embodiments of the present invention, although the reflection type plasma display device has been described, the present invention is applicable not only to the reflection type but also to a transparent type plasma display device. Since luminescence of the phosphor layer is observed through the second substrate in the transparent type plasma display device, it does not matter whether a conductive material constituting the discharge sustain electrode is transparent or opaque. Since the address electrode is prepared on the second substrate, a transparent address electrode may have an advantage with respect to brightness.

In addition, in the above mentioned preferred embodiments, the barrier rib 24 extending substantially in parallel with the address electrode 22 is formed in stripes, however, the present invention is not limited thereto and the barrier rib 24 may have a meander structure or other structures. In addition, by rendering the barrier rib 24 black, a so-called black matrix may be formed and the display screen of high contrast may be provided. As a method of making the barrier rib black, a method of forming a barrier rib using a color resist material colored in black may be illustrated.

In the above preferred embodiments, one pair of discharge sustain electrodes 12 extending in parallel with each other, however, alternatively another structure may be provided such that a pair of bus electrodes 13 may extend in the first direction X, between the pair of bus electrodes 13 one discharge sustain electrode 12 extends from one bus electrode 13 to the front of the other bus electrode 13 in the second direction Y, and the other discharge sustain electrode 12 extends from the other bus electrode 13 to the front of the one bus electrode 13 in the second direction Y Moreover, still another structure may be arranged such that the one discharge sustain electrode 12 extending in the first direction X, out of the pair of the discharge sustain electrodes 12, is formed at the first substrate 11, while the other discharge sustain electrode 12 is formed at an upper portion of a sidewall of the barrier rib in parallel with the address electrode 22. In addition, the address electrode may be formed in the first substrate.

An alternating current drive type plasma display device having such a structure may be arranged to have, for example, a pair of discharge sustain electrodes 12 extending in the first direction X and the address electrode 22 formed in the vicinity of one of the pair of discharge sustain electrodes 12 along one of the pair of discharge sustain electrodes 12 (however, the length of the address electrode 22 along the one of the pair of discharge sustain electrodes 12 is within the length along the first direction X of a discharge cell). In addition in order to avoid short circuiting to the discharge sustain electrode 12, wiring for the address electrode extending in the second direction Y is provided through an insulation layer, and the wiring for the address electrode and the address electrode may be electrically connected with each other, the address electrode may extend from the wiring for address electrode.

EXAMPLES OF PREFERRED EMBODIMENTS

The present invention will be described below according to detailed examples of the preferred embodiments, however, the present invention is not limited thereto.

First Example of Preferred Embodiment

Example 1

The three-electrode type plasma display device which has the structure as shown in FIG. 1 is prepared according to the method as will be described in the following.

The first panel 10 was produced by the following methods. At first, a plurality pairs of discharge sustain electrodes 12 were formed by forming an ITO layer by the sputtering process, for example, over the whole first substrate 11 made from the high distortion point glass or soda glass, and carrying out patterning of the ITO layer with photolithography technology and etching technology in stripes. The discharge sustain electrodes 12 are extended in the first direction X. In addition the interval between one pair of discharge sustain electrodes 12 (discharge gap G) was set to $2\times10^{-5}$ m (20 $\mu$m).

Next, the bus electrodes 13 were formed along an edge of each discharge sustain electrode 12 by forming an aluminum film, a copper film, etc. in the whole surface by means of the vacuum evaporation process, for example, and carrying out patterning of the aluminum film, the copper film, etc. by means of the photolithography technology and the etching technology. Then, the dielectric layer 14 (its average thickness on the discharge sustain electrode 12 is 7 $\mu$m) made of $SiO_x$ (the value of x is approximately 2) was formed in the whole surface, and the protective film 15 made of magnesium oxide (MgO) with a thickness of 0.6 $\mu$m was formed on it by means of the electronic beam vacuum evaporation process. Therefore, the first panel 10 was completed according to the above processes.

In addition, the dielectric layer 14 made of $SiO_x$ was prepared by means of a high frequency magnetron sputter equipment and by a sputter process under conditions as illustrated below (a sputter film/a little degassing).

| | |
|---|---|
| Target: | $SiO_2$, |
| Process gas: | Ar = 240 sccm and<br>O2 = 60 sccm, |
| Chamber pressure: | 0.3 Pa |
| RF power: | 900 W |
| Actual substrate temperature: | Room temperature. |

In addition, the second panel 20 was prepared by the following methods. At first, a silver paste was printed in stripes on the second substrate 21 made of high distortion point glass or soda glass by the screen printing process, for example, and baked so as to form the address electrodes 22. The address electrode 22 extends in the second direction Y which is orthogonal to the first direction X. Next, the low melting point glass paste layer was formed in the whole surface by the screen printing process, and the dielectric film 23 was formed by baking the low melting point glass paste layer. Then, the low melting point glass paste was printed on the dielectric film 23 above an area between adjacent address electrodes 22 by means of the screen printing process, for example, then baked so as to form the barrier rib 24. Next, fluorescent substance slurry in three primary colors was printed one by one and baked so as to form the phosphor layers 25R, 25G, and 25B continuously from the top of the dielectric film 23 between the barrier ribs 24 to the surface of the sidewall of the barrier ribs 24. Thus, the second panel 20 was completed according to the above process.

Next, the assembly of a plasma display device was performed. At first, the seal layer (frit glass layer) was formed at peripheral edges the second panel 20 by means of a frit dispenser, for example. Next, the first panel 10 and the second panel 20 were laminated to each other and baked to cure the seal layer. Then, after exhausting air from the space formed between the first panel 10 and the second panel 20, a gas (Xe 100% gas, 30 kPa) was introduced, and the space was hermetically sealed, whereby the plasma display device was completed.

Figure 3:
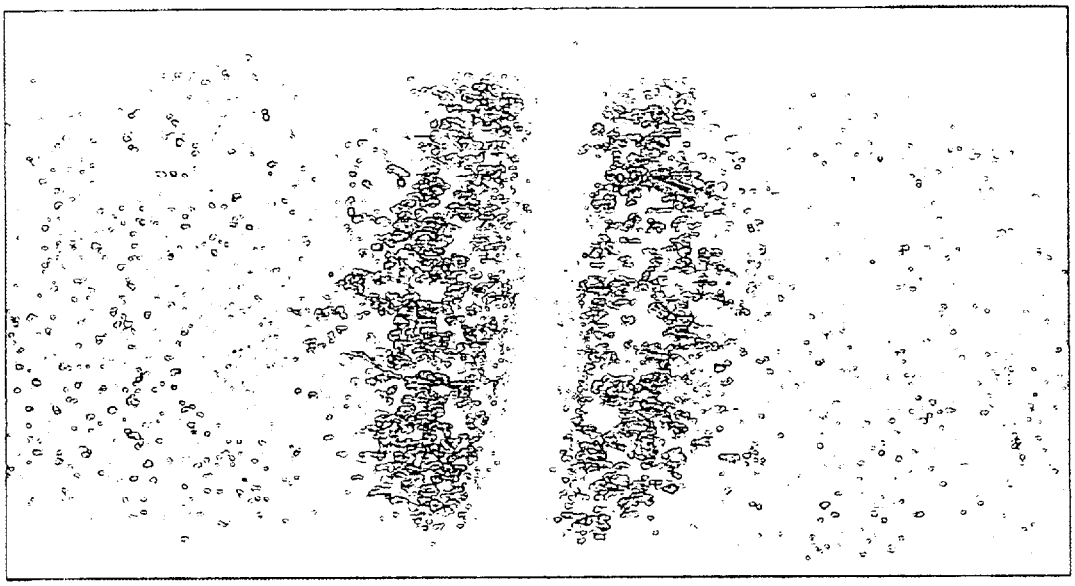
FIG. 3 is a view of a photograph qualitatively showing damages on a protective film surface in the plasma display device according to an example of the preferred embodiment of the present invention.
Figure 5:
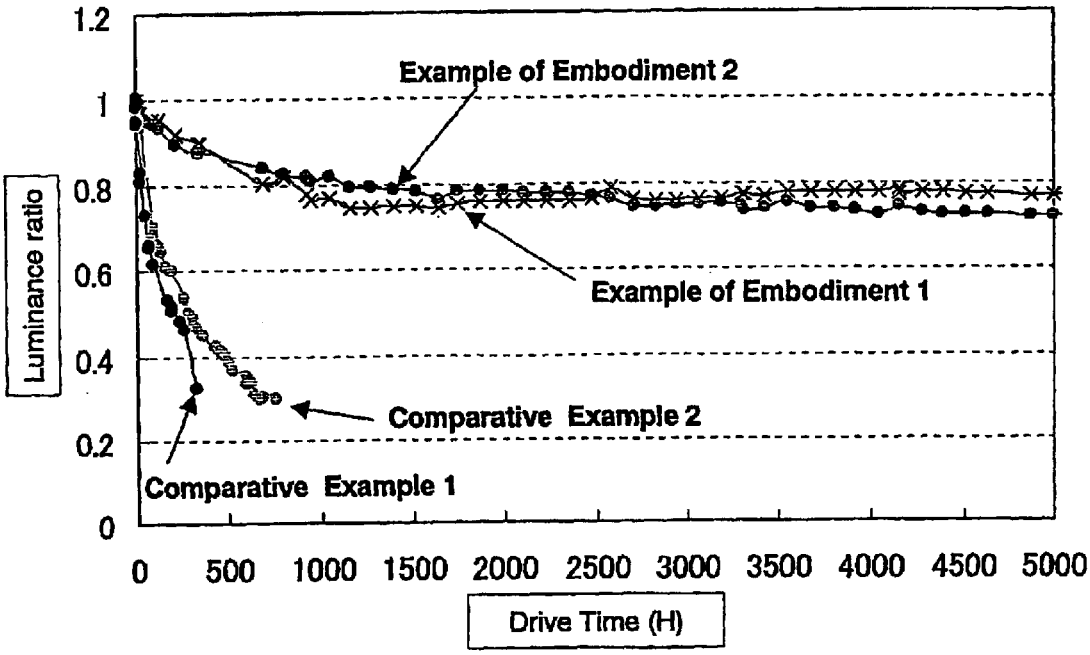
FIG. 5 is a graph showing a luminance change over time in the plasma display devices according to examples of the preferred embodiments of the present invention and comparative examples.

The luminance of the thus obtained plasma display device was measured and a luminance change over time thereof was measured. The results are shown in FIG. 5. Moreover, a resulting photograph taken around the discharge gap G from the protective film 15 side after 185 hours is shown in FIG. 3.

Figure 6:
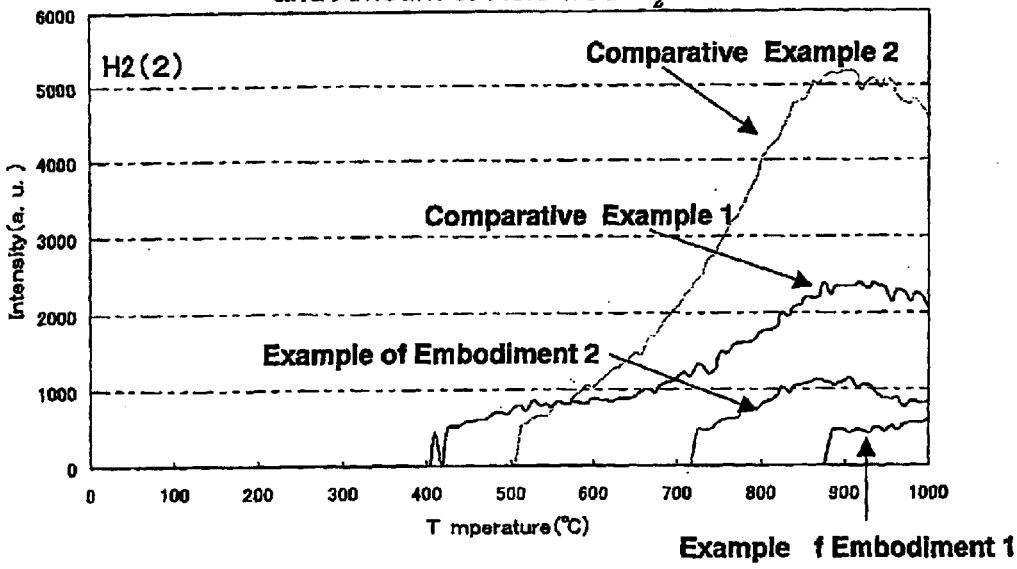
FIG. 6 is a graph showing a relationship between each dielectric film according to the examples of the preferred embodiment of the present invention and the comparative examples, and an amount of $H_2$ gas release.
Figure 7:
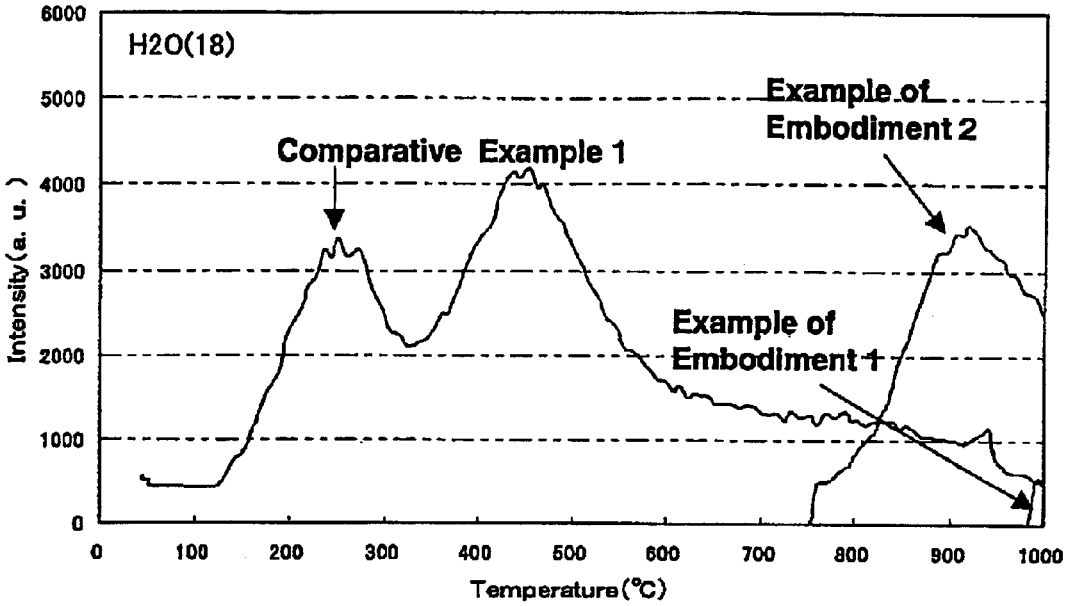
FIG. 7 is a graph showing a relationship between each dielectric film according to the examples of the preferred embodiment of the present invention and the comparative examples, and an amount of $H_2O$ gas release.

The $SiO_x$ (value of x is approximately 2) film with a thickness of 7 $\mu$m was formed on a sample substrate under the same conditions as having formed the dielectric layer 14 in this example, and the amount of degassing (the amount of $H_2$ gas release and the amount of $H_2O$ gas release) when increasing the temperature from room temperature to 1000° C. were measured by means of a TDS (acronym of thermal desorption mass spectroscopy). The results are shown in Table 1 and FIGS. 6 and 7.

TABLE 1

| | $H_2$ (particles/cm$^3$) | $H_2O$ (particles/cm$^3$) |
|---|---|---|
| Example of Embodiment 1 | $3\times10^{19}$ | $5\times10^{19}$ |
| Example of Embodiment 2 | $7\times10^{19}$ | $4\times10^{20}$ |
| Comparative Example 1 | $2\times10^{20}$ | $6\times10^{20}$ |
| Comparative Example 2 | $7\times10^{20}$ | $2\times10^{20}$ |

Second Example of Preferred Embodiment

Example 2

Except that the dielectric layer 14 (a CVD film/little degassing) made of $SiO_x$ was formed by means of the plasma CVD process under the conditions shown below, the luminance of the plasma display device was measured and a luminance change over time was measured in a similar way to the Example of Embodiment 1. The results are shown in FIG. 5. Moreover, the $SiO_x$ (value of x is approximately 2) film with a thickness of 7 $\mu$m was formed on the sample substrate under the same conditions as that the dielectric layer 14 was formed in this example of the preferred embodiment, then the amount of degassing (the amount of $H_2$ gas release and the amount of $H_2O$ gas release) when increasing the temperature from room temperature to 1000° C. were measured by means of the TDS. The results are shown in Table 1 and FIG. 6 and FIG. 7.

| | |
|---|---|
| Process gas: | $SiH_4$ = 330 sccm and<br>$N_2O$ = 8000 sccm |
| Gas pressure: | 266 Pa |
| RF power: | 2000 W |
| Actual substrate temperature: | 330° C. |

Comparative Example 1

Except that the thickness of the protective film 15 was rendered 0.9 $\mu$m and the dielectric layer 14 (a sputter film/high degassing) made of $SiO_x$ was formed by means of the sputter process under the conditions as shown below the luminance of the plasma display device was measured and a luminance change over time was measured in a similar way to Example 1. The results are shown in FIG. 5.

Figure 4:
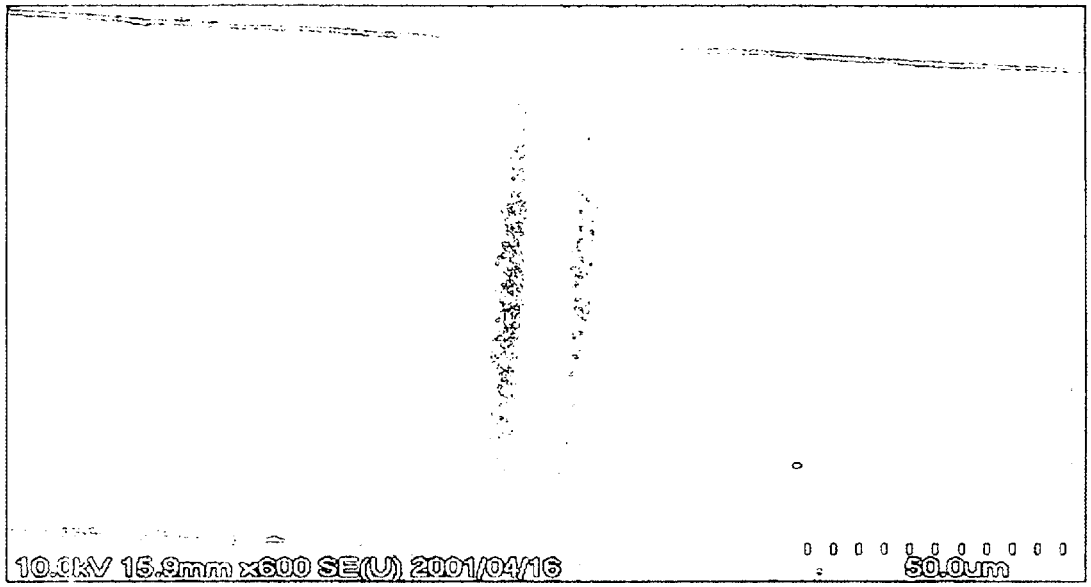
FIG. 4 is a view of photograph qualitatively and relatively showing damages on the protective film surface in the plasma display device according to a comparative example.

Moreover, the result in the photograph taken around the discharge gap G from the protective film 15 side after 185 hour is shown in FIG. 4.

A $SiO_x$ (value of x is approximately 2) film with a thickness of 7 μm was formed on the sample substrate under the same conditions as that the dielectric layer 14 was formed in this comparative example, and the amount of degassing (the amount of $H_2$ gas release and the amount of $H_2O$ gas release) when increasing the temperature from room temperature to 1000° C. were measured by means of the TDS. The results are shown in Table 1 and FIG. 6 and FIG. 7.

| | |
|---|---|
| Target: | $SiO_2$ |
| Process gas: | Ar = 300 sccm |
| Chamber pressure: | 0.3 Pa |
| RF power: | 900 W |
| Actual substrate temperature: | Room temperature |

Comparative Example 2

Except that the dielectric layer 14 (a CVD film/high degassing) made of $SiO_x$ was formed by means of the plasma CVD process under the conditions shown below, the luminance of the plasma display device was measured and a luminance change over time was measured in a similar way to Example 1. The results are shown in FIG. 5.

Moreover, the $SiO_x$ (value of x is approximately 2) film with a thickness of 7 μm was formed on the sample substrate under the same conditions as that the dielectric layer 14 was formed in this comparative example, then the amount of degassing (the amount of $H_2$ gas release and the amount of $H_2O$ gas release) when increasing the temperature from room temperature to 1000° C. were measured by means of the TDS. The results are shown in Table 1 and FIG. 6 and FIG. 7.

| | |
|---|---|
| Process gas: | $SiH_4$ = 450 sccm, $N_2O$ = 7000 sccm |
| Gas pressure: | 200 Pa |
| RF power: | 1600 W |
| Actual substrate temperature: | 320° C. |

Evaluation

As shown in Table 1 and FIG. 4 to FIG. 7, the plasma display devices that were provided according to the Examples 1 and 2 of the preferred embodiments each had the dielectric layer 14 made of the low degassing film from which the total amounts of the degassing when increasing the temperature from room temperature to 1000° C. were not exceeding $1\times10^{20}$ particles/$cm^3$ for hydrogen molecules and not exceeding $5\times10^{20}$ particles/$cm^3$ for water showed that they allowed improvement in luminance, a little fall of discharge voltage, and a small luminance change over time compared with the plasma display devices according to the comparative examples 1 and 2. Further, in Example 1 of the preferred embodiment, it showed improvement in luminance as the thickness of the dielectric layer 14 became thinner. In addition, it was found out that according to the Examples of the preferred embodiments of the present invention, the damages to the protective film were reduced by comparing FIG. 3 with FIG. 4.

Although the present invention has been described hereinabove in its preferred form with a certain degree of particularity, many other changes, variations, combinations and sub-combinations are possible therein. It is therefore to be understood by those of ordinary skill in the art that any modifications will be practiced otherwise than as specifically described herein without departing from the scope and spirit of the present invention.

What is claimed is:

1. A plasma display device comprising:

a first substrate;

a second substrate disposed facing an inside of said first substrate and forming a hermetically sealed discharge space therebetween;

at least a pair of discharge sustain electrodes formed inside said first substrate and mutually forming a discharge gap; and a dielectric layer formed inside said first substrate so as to cover said discharge sustain electrodes; wherein said dielectric layer has a low degassing film in which a total amount of degassing when increasing a temperature from room temperature to 1000° C. comprises hydrogen molecules not exceeding $1\times10^{20}$ particles/$cm^3$ and water molecules not exceeding $5\times10^{20}$ particles/$cm^3$.

2. The plasma display device according to claim 1 wherein a thickness of said dielectric layer does not exceed $5.0\times10^{-5}$ m.

3. The plasma display device according to any of claims 1 and 2, wherein on said second substrate side there is formed a plurality of address electrodes along a direction which crosses with said discharge sustain electrodes; and there is formed a second substrate side dielectric layer.

4. The plasma display device according to claim 3, wherein said second substrate side dielectric layer has a low degassing film in which a total amount of degassing when increasing a temperature from room temperature to 1000° C. comprises hydrogen molecules not exceeding $1\times10^{20}$ particles/$cm^3$ and water molecules not exceeding $5\times10^{20}$ particles/$cm^3$.

5. The plasma display device according to any of claims 1 to 4, wherein said low degassing film has a low degassing film in which a total amount of degassing when increasing a temperature from room temperature to 500° C. comprises hydrogen molecules not exceeding $5\times10^{19}$ particles/$cm^3$ and water molecules not exceeding $5\times10^{19}$ particles/$cm^3$.

6. The plasma display device according to any of claims 1 to 5, wherein said low degassing film comprises one of an oxide, a nitride and an oxynitride.

7. The plasma display device according to any of claims 1 to 6, wherein there is formed a protective film on an internal surface facing a discharge space of said dielectric layer.

8. A plasma display device manufacturing method for manufacturing a plasma display device according to any of claims 1 to 7, wherein said low degassing film is formed by one of a chemical vapor deposition method, a sputtering method, an evaporation method, an ion plating method, a printing method, a dry film method, an application method and a transfer method.

9. The plasma display device manufacturing method according to claim 8, wherein said low degassing film has a substrate temperature of 30° C. or more, when formed by the chemical vapor deposition method.

10. The plasma display device manufacturing method according to claim 8, wherein said low degassing film has a partial pressure of oxygen of 15 volume percent or more, when formed by the sputtering method.

* * * * *